US006827581B2

(12) United States Patent
Ho et al.

(10) Patent No.: US 6,827,581 B2
(45) Date of Patent: Dec. 7, 2004

(54) ELECTRONIC DEVICE AND ROTATABLE DISPLAY THEREOF

(75) Inventors: Pei-Jan Ho, Taipei (TW); Po-Tien Wang, Taipei Shien (TW)

(73) Assignee: Quanta Computer, Inc., Taoyuan (TW)

( * ) Notice: Subject to any disclaimer, the term of this patent is extended or adjusted under 35 U.S.C. 154(b) by 3 days.

(21) Appl. No.: 10/614,588

(22) Filed: Jul. 7, 2003

(65) Prior Publication Data

US 2004/0192073 A1 Sep. 30, 2004

(30) Foreign Application Priority Data

Mar. 28, 2003 (TW) ..... 92107055 A

(51) Int. Cl.[7] ..... H01R 39/00
(52) U.S. Cl. ..... 439/22; 361/681; 248/921
(58) Field of Search ..... 439/22, 21, 20, 439/27; 361/681, 682; 248/917–924

(56) References Cited

U.S. PATENT DOCUMENTS 5,335,142 A * 8/1994 Anderson ..... 361/681
5,638,257 A * 6/1997 Kumar et al. ..... 361/680
5,690,498 A * 11/1997 Sobhani ..... 439/22
5,873,554 A * 2/1999 Nobuchi ..... 248/278.1
6,007,344 A * 12/1999 Corrunker et al. ..... 439/22
6,048,211 A * 4/2000 Liaom ..... 439/4
6,248,017 B1 6/2001 Roach ..... 463/37
6,483,445 B1 * 11/2002 England ..... 341/22
6,567,677 B1 5/2003 Sokoloff ..... 455/575

* cited by examiner

*Primary Examiner*—Gary Paumen
(74) *Attorney, Agent, or Firm*—Thomas, Kayden, Horstemeyer & Risley

(57) ABSTRACT

An electronic device having rotatable display. The rotatable display includes a data transmission board having at least one first connector, a first locating plate on which the data transmission board is secured, a second locating plate for rotational engagement with the first locating plate and a printed circuit board having a plurality of concentric connecting portions secured on the second locating plate. The first connector maintains contact with the connecting portions for signal transmission by means of the rotational engagement of the first locating plate and the second locating plate.

13 Claims, 9 Drawing Sheets

ELECTRONIC DEVICE AND ROTATABLE DISPLAY THEREOF

BACKGROUND ACCORDING TO THE INVENTION

1. Field According to the Invention

The present invention relates to an electronic device, and in particular to an electronic device having a rotatable display.

2. Description of the Related Art

As one skilled in the art knows, the orientation of the characters shown on a personal digital assistant (PDA) is perpendicular to the orientation of the characters shown on a personal computer. When transferring between different operating systems (OS) on electronic devices, for example, when transferring from Windows CE to Windows XP, users often are required to rotate the whole device with 90 degrees of angle to accommodate viewing of landscape vs. portrait display orientations. However, this can complicate both viewing and data input.

U.S. Pat. No. 6,567,677 reveals a notebook computer telephone wherein a switch dictates display position to turn the power on or off. U.S. Pat. No. 6,248,017 discloses a handheld game with rotatable display wherein a plurality of switches corresponding to each viewer position provides input to a controller. R.O.C. patent No. 460759 provides a switch detecting the position of the display.

Many rotational mechanisms can be found in the electronic products in recent market, but none provide full use, including data input when rotated.

SUMMARY ACCORDING TO THE INVENTION

Accordingly, an object according to the invention is to provide an electronic device with fully functioning rotatable display.

The invention provides a data transmission board having at least one first connector, a first locating plate on which the data transmission board is secured, a second locating plate for rotational engagement with the first locating plate and a printed circuit board having a plurality of concentric connecting portions secured on the second locating plate. The first connector maintains contact with the connecting portions for signal transmission by means of the rotational engagement of the first locating plate and the second locating plate.

A detailed description on PDA as an preferred embodiment according to the invention is given as follows with reference to the accompanying drawings. However, the scope according to the invention is not limited in PDA.

BRIEF DESCRIPTION OF THE DRAWINGS

The present invention can be more fully understood by reading the subsequent detailed description and examples with references made to the accompanying drawings, wherein.

DETAILED DESCRIPTION ACCORDING TO THE INVENTION

Figure 1A:
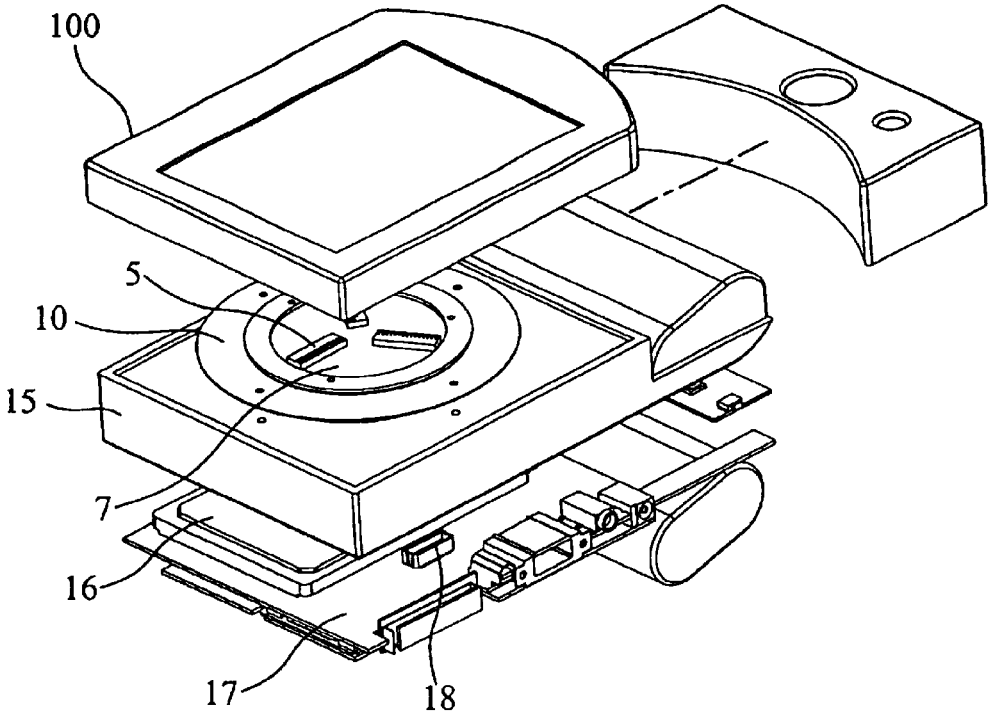
FIG. 1A is an exploded perspective view of a PDA according to the invention.
Figure 1B:
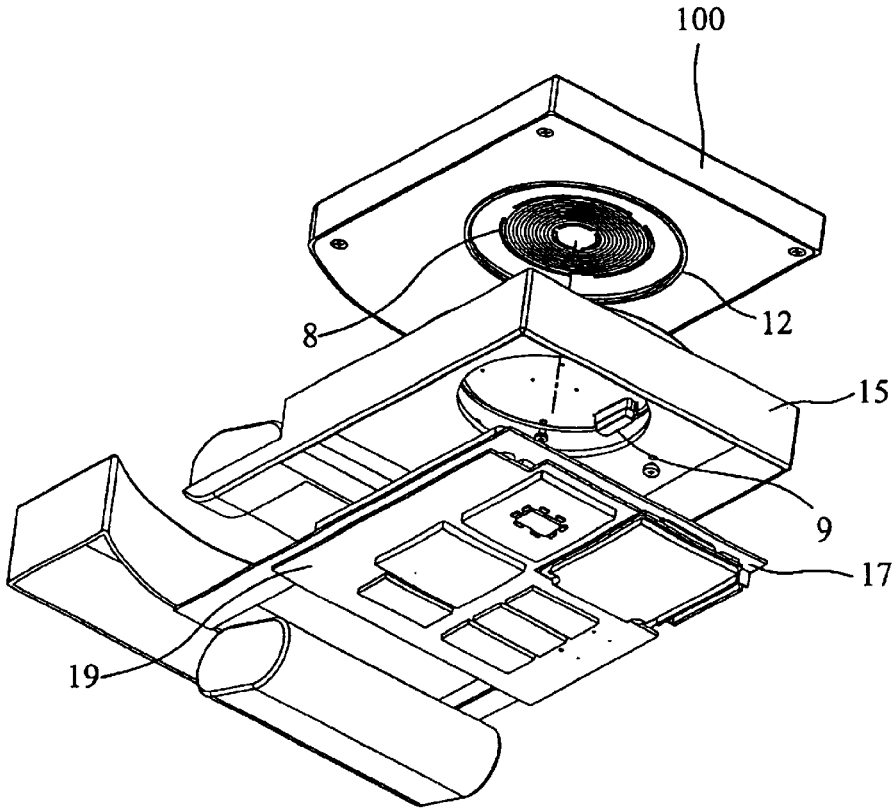
FIG. 1B is another exploded perspective view of a PDA according to the invention.

As shown in FIGS. 1A, 1B, the electronic device according to the invention comprises a liquid crystal display module 100, a data transmission module comprising a data transmission board 7 and a locating plate 10 (also called the first locating plate), and frame module 15 for receiving and adjoining the data transmission module 7 the liquid crystal display module 100.

The electronic device according to the invention further comprises a hard disk drive 16 and printed circuit boards 17, 19(shown in FIG. 1B), wherein the hard disk drive 16 is mounted under the frame module 15. A third connector 18 on the printed circuit board 17 is connected to a second connector 9 on the data transmission board 7 (shown in FIG. 1B).

Figure 2:
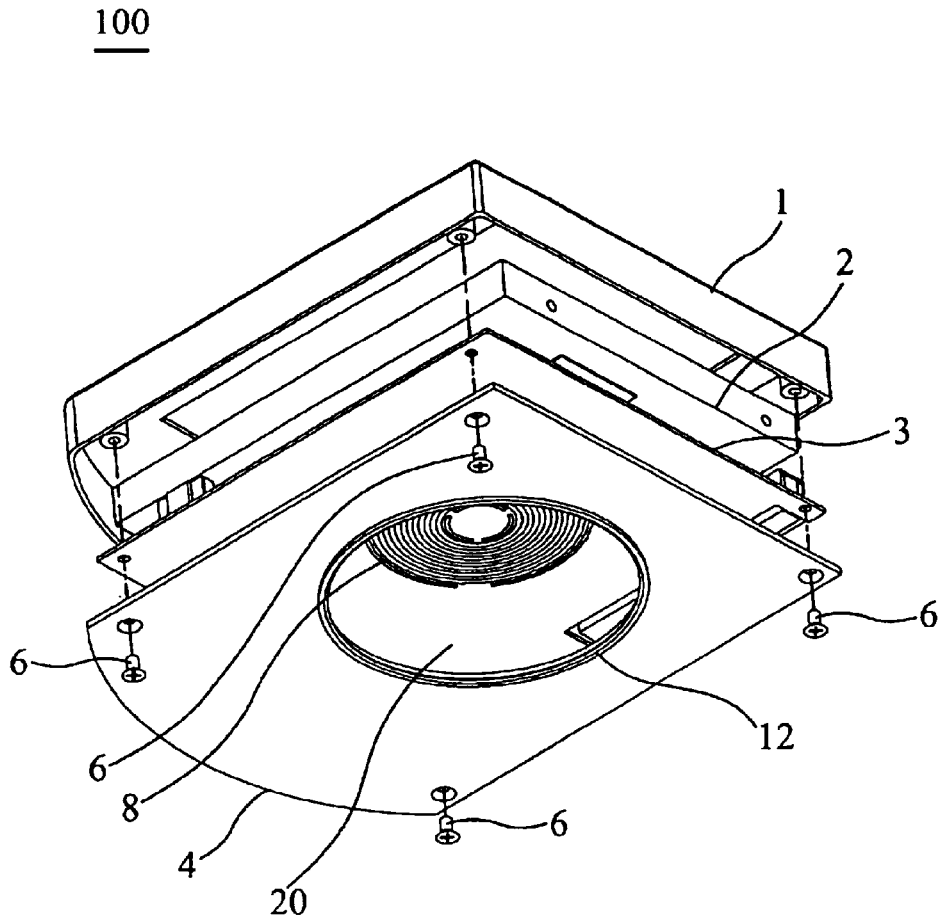
FIG. 2 is a an exploded perspective view of a liquid crystal display module according to the invention.

As shown in FIG. 2, the liquid crystal display module 100 comprises an upper guard member 1, a liquid crystal display 2, a printed circuit board 3 and a lower guard member 4 (also called the second locating plate). The parts of the liquid crystal display module 100 are assembled with a securing means such as bolts 6. The printed circuit board 3 is provided with a plurality of concentric connecting portions 8 and the lower guard member 4 is provided with a circular first opening 20 corresponding to the connecting portions 8 and having a flange 12 thereon.

Figure 3:
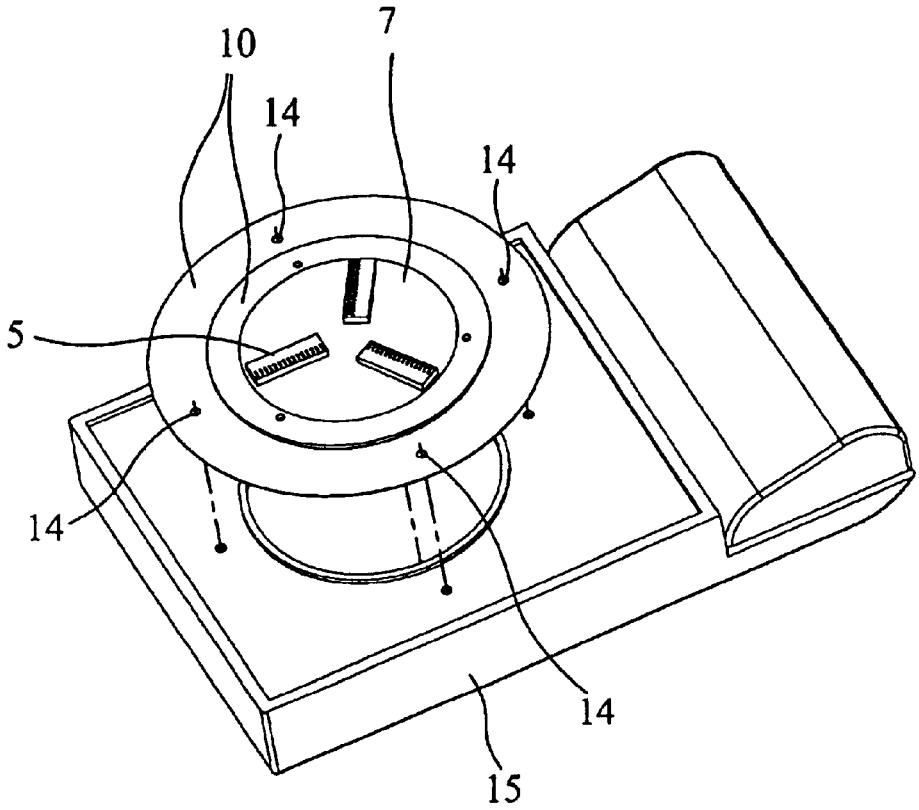
FIG. 3 is a perspective view of the assembly of a data transmission module and frame module according to the invention.

As shown in FIG. 3, the data transmission module comprising the data transmission board 7 and the locating plate 10 is secured on the frame module 15 by bolts 14.

Figure 4A:
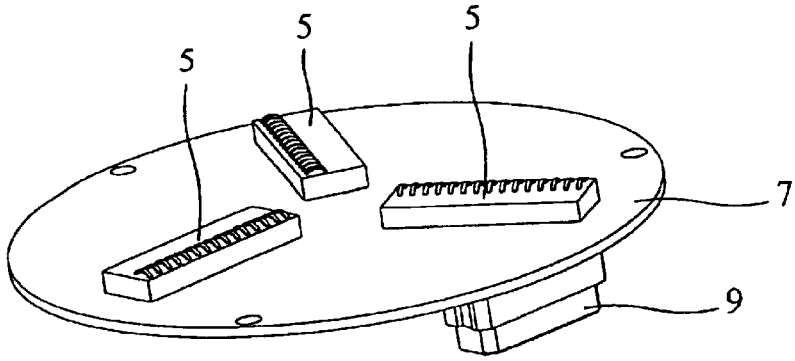
FIG. 4A is a perspective view of the data transmission board.
Figure 4B:
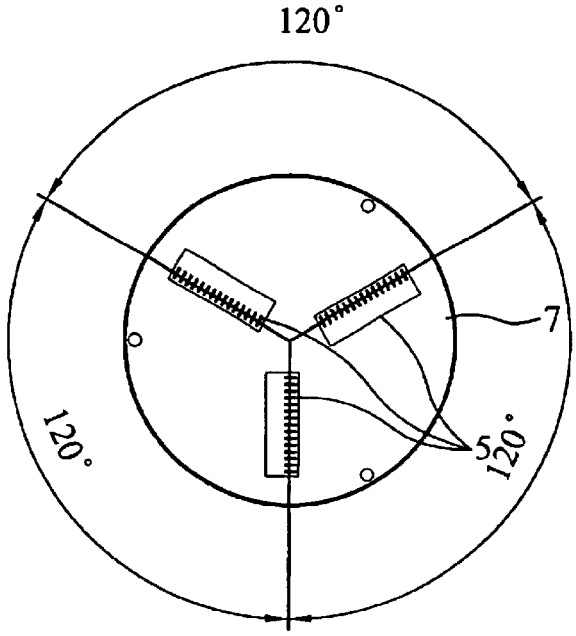
FIG. 4B is a top view of the data transmission board according to the invention.
Figure 4C:
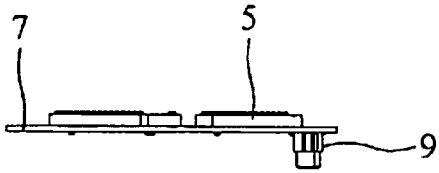
FIG. 4C is a side view of the data transmission board according to the invention.

As shown in FIG. 4A, the data transmission board 7 is provided with several identical first connectors 5. For example, three identical first connectors 5 are circularly disposed on the data transmission board 7 and the first connectors 5 are separated by 120° as shown in FIG. 4B. Furthermore, the data transmission board 7 is provided with the second connector 9 on the bottom thereof as shown in FIGS. 4A and 4C.

Figure 5:
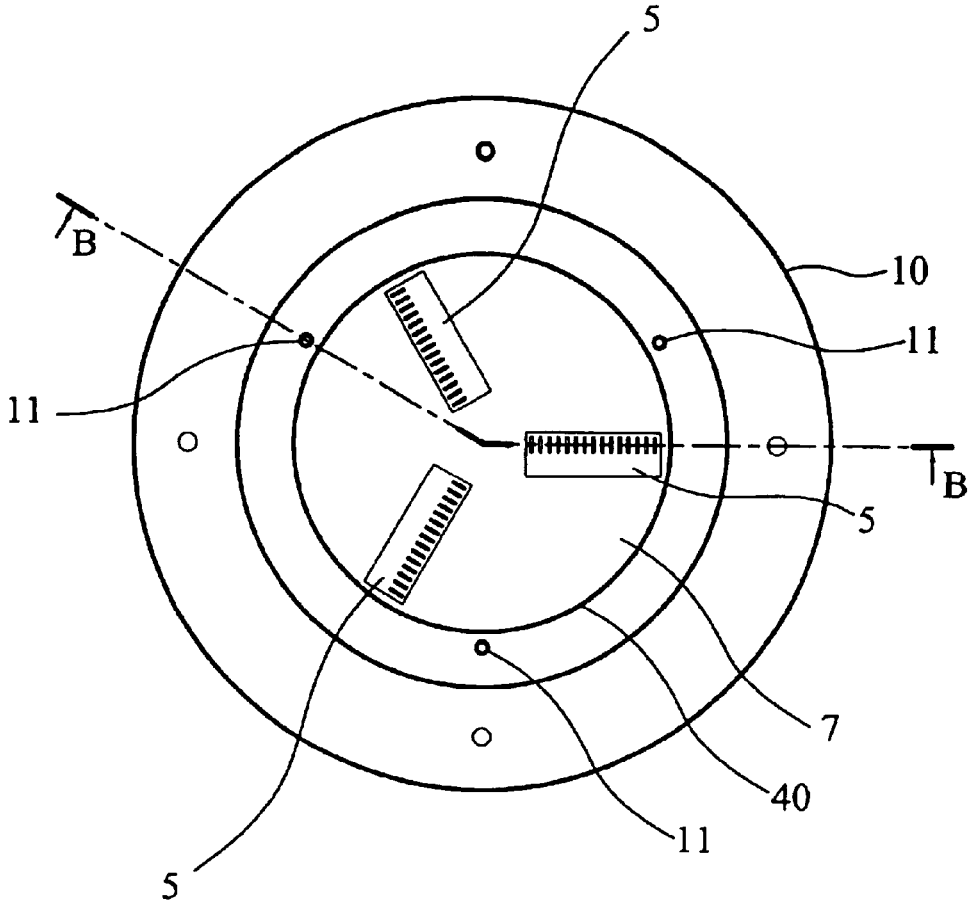
FIG. 5 is top view of the assembly of the data transmission board and the first locating plate.

The data transmission module according to the invention comprises the circular locating plate 10 and the data transmission board 7. As shown in FIG. 5, the locating plate 10 is provided with a circular second opening 40 to prevent the first connector 5 from obstructing the connection of data transmission board 7 and the locating plate 10.

The frame module 15 may receive the data transmission board 7 and the locating plate 10 as well as adjoining the liquid crystal display module 100 so that the liquid crystal display module 100 may rotate thereon.

Figure 6A:
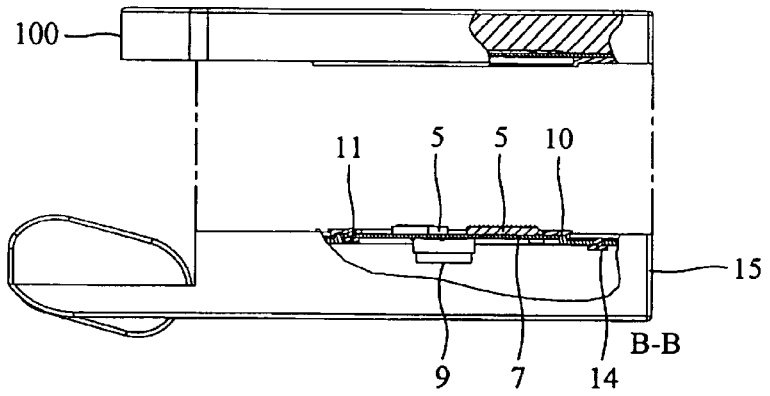
FIG. 6A is a side view of the assembly of the liquid crystal display module, the data transmission module, and the frame module according to the invention.
Figure 6B:
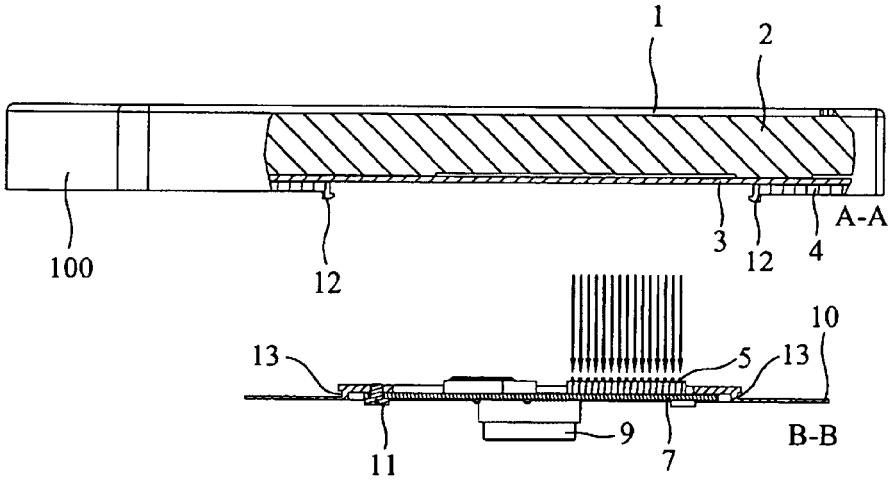
FIG. 6B is a cross section of the liquid crystal display module and the data transmission board according to the invention.

FIG. 6B shows the assembly of the liquid crystal display module 100 and the data transmission module (including the circular locating plate 10 and the data transmission board 7). The locating plate 10 is provided with a groove 13 engaging with the flange 12 on the lower guard member 4 so that the first connector 5 can maintain contact with the connecting portions 8 (shown in FIG. 2). The first connector 5 can be an elastic member made of metal. Thus, the first connector 5 maintains contact with the connecting portions 8 by elastic force thereof to ensure the signal transmission.

Figure 7A:
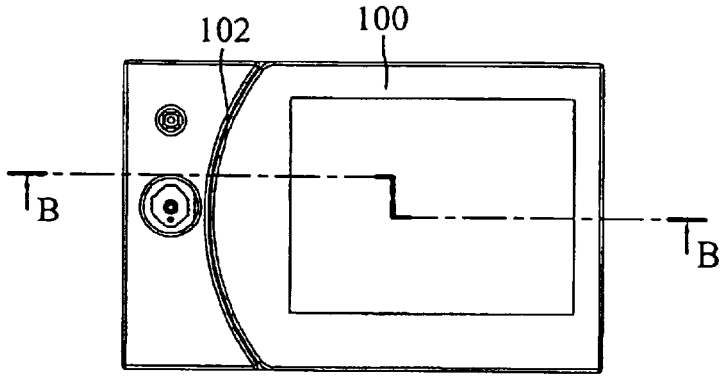
FIG. 7A is a top view of the electronic device according to the invention.
Figure 7B:
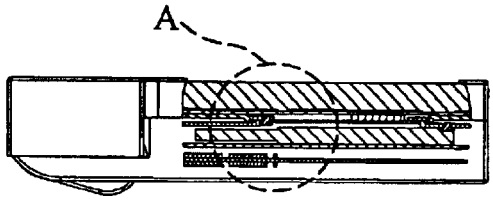
FIG. 7B is a cross section of the electronic device according to the invention along line B—B in FIG. 7A.
Figure 7C:
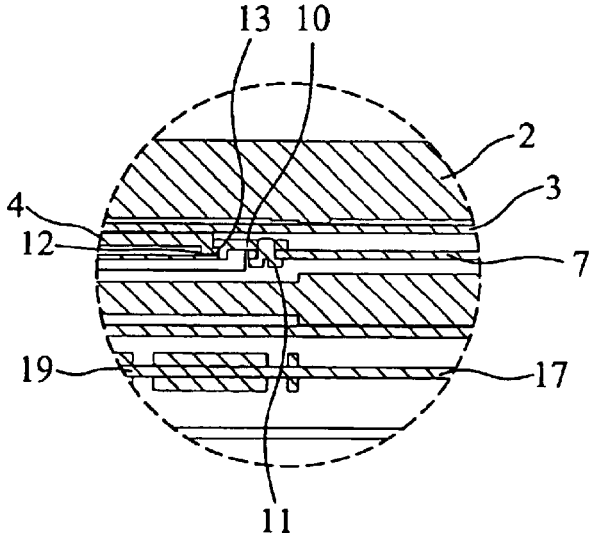
FIG. 7C is a partially enlarged view of portion A of the electronic device according to the invention in FIG. 7B.
Figure 8A:
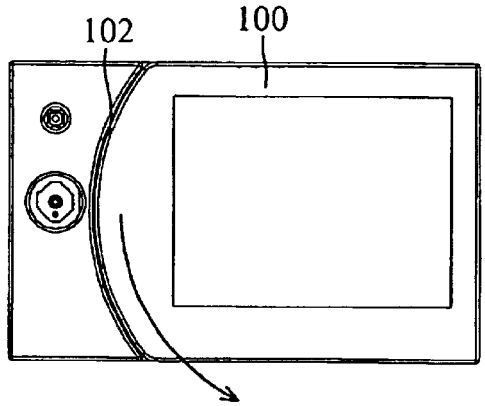
FIGS. 8A, 8B and 8C are schematic views of the liquid crystal display module of the electronic device according to the invention.
Figure 8B:
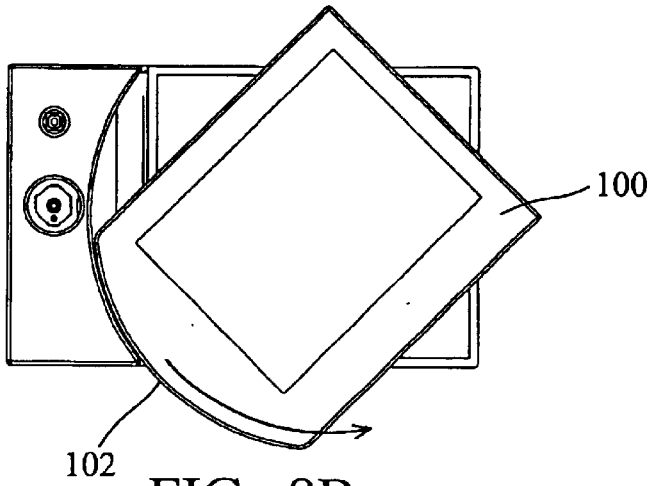
Figure 8C:
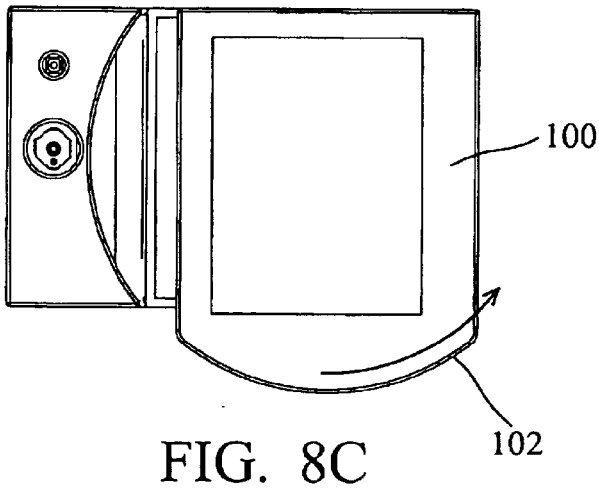

Referring to FIGS. 7A, 7B & 7C, the liquid crystal display module 100 is provided with a curved portion 102 which facilitates the liquid crystal display module 100 rotating around the center of the data transmission board 7.

Thereby, signals from printed circuit board 17 are transmitted to the printed circuit board 3 in the liquid crystal display module 100 through the third connector 18, the second connector 9, the data transmission board 7, the first connector 5 and the connecting portions 8.

Moreover, the engagement of the lower guard member 4 and the locating plate 10 ensures contact between the first connector 5 and connecting portions 8 so as to maintain data transmission.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A rotatable display for an electronic device, comprising:

a data transmission board having at least one first connector;

a first locating plate on which the data transmission board is secured;

a second locating plate rotationally engaging with the first locating plate; and a printed circuit board having a plurality of concentric connecting portions and secured on the second locating plate;

wherein the first connector maintains contact with the connecting portions for signal transmission by the rotational engagement of the first locating plate and the second locating plate.

2. The rotatable display for an electronic device as claimed in claim 1, wherein the first locating plate has a circular first opening provided with a groove on the periphery thereof.

3. The rotatable display for an electronic device as claimed in claim 2, wherein the second locating plate has a circular second opening provided with a flange on the periphery thereof and the flange is fitted with the groove so that the first locating plate rotationally engages with the second locating plate.

4. The rotatable display for an electronic device as claimed in claim 1, wherein the first locating plate is a rotatable circular member.

5. The rotatable display for an electronic device as claimed in claim 1, wherein three first connectors are circularly disposed on the data transmission board corresponding to the position of the connecting portions and separated by 120°.

6. The rotatable display for an electronic device as claimed in claim 1, wherein the data transmission board further comprises a second connector for other devices.

7. The rotatable display for an electronic device as claimed in claim 1, wherein the data transmission board is fixed on the first locating plate by bolts.

8. An electronic device, comprising:

a liquid crystal display module comprising an upper guard member, a liquid crystal display unit, a printed circuit board with a plurality of concentric connecting portions, and a lower guard member with a circular first opening having a flange on the periphery thereof, wherein the liquid crystal display unit and the printed circuit board are disposed between the upper guard member and lower guard member, and the printed circuit board is fixed on the lower guard member;

a data transmission module provided with at least one first connector contacting the connecting portions to transmit signals;

a locating plate provided with a circular second opening having a groove on the periphery thereof to fit with the flange to maintain rotational engagement of the locating plate and the lower guard member and fix the data transmission module thereon; and a frame module receiving the data transmission module and the locating plate and joining to the liquid crystal display module;

wherein the liquid crystal module rotates on the frame module and the first connector maintains contact with the connecting portions to maintain data transmission by means of the rotational engagement of the locating plate and the lower guard member.

9. The electronic device as claimed in claim 8, wherein the locating plate is a rotatable circular member.

10. The electronic device as claimed in claim 8, wherein the liquid crystal module has a curved portion rotating around the center of the data transmission module.

11. The electronic device as claimed in claim 8, wherein three first connectors are circularly disposed on the data transmission module corresponding to the position of the connecting portions and separated by 120°.

12. The electronic device as claimed in claim 8, wherein the data transmission board further comprises a second connector for other devices.

13. The electronic device as claimed in claim 8, wherein the data transmission board is fixed on the first locating plate by means of bolts.

* * * * *